US010012184B2

(12) United States Patent
Guidi

(10) Patent No.: US 10,012,184 B2
(45) Date of Patent: Jul. 3, 2018

(54) EGR DEVICE HAVING DIFFUSER AND EGR MIXER FOR EGR DEVICE

(71) Applicants: DENSO International America, Inc., Southfield, MI (US); DENSO CORPORATION, Kariya, Aichi-pref. (JP)

(72) Inventor: Paolo Guidi, Macomb, MI (US)

(73) Assignee: DENSO International America, Inc., Southfield, MI (US)

( * ) Notice: Subject to any disclaimer, the term of this patent is extended or adjusted under 35 U.S.C. 154(b) by 206 days.

(21) Appl. No.: 14/556,868

(22) Filed: Dec. 1, 2014

(65) Prior Publication Data

US 2016/0153404 A1 Jun. 2, 2016

(51) Int. Cl.

| | |
|---|---|
| ***F02M 26/06*** | (2016.01) |
| ***F02M 26/19*** | (2016.01) |
| *F02M 26/10* | (2016.01) |
| *F02M 26/21* | (2016.01) |

(52) U.S. Cl.

CPC ..... *F02M 26/06* (2016.02); *F02M 26/19* (2016.02); *F02M 26/10* (2016.02); *F02M 26/21* (2016.02)

(58) Field of Classification Search

CPC ..... F02M 26/05; F02M 26/19; F02M 26/10; F02M 26/21; F02M 26/13; F02M 23/003; F02M 21/04; F02M 21/042; F02M 21/045; F02M 21/047; F02M 35/10209; F02M 35/10222

USPC ..... 123/568.17, 568.18; 239/461, 462, 499, 239/504, 398, 407, 416.4, 416.5, 433, 239/434.5, 200, 201, 203, 204, 205, 206

See application file for complete search history.

(56) References Cited

U.S. PATENT DOCUMENTS

| | | | | | |
|---|---|---|---|---|---|
| 1,382,285 | A | * | 6/1921 | Harris | F02M 26/19 123/556 |
| 1,432,751 | A | * | 10/1922 | Hallett | F02M 26/19 123/568.17 |
| 1,539,126 | A | * | 5/1925 | Link | F02M 26/19 123/545 |
| 2,465,155 | A | * | 3/1949 | Higley | F23D 14/04 126/39 H |
| 2,615,510 | A | * | 10/1952 | James | F23D 14/06 239/434 |
| 3,245,540 | A | * | 4/1966 | Johnson | B01D 24/12 210/291 |
| 3,680,534 | A | * | 8/1972 | Chavant | F02M 26/19 123/568.17 |
| 3,710,770 | A | * | 1/1973 | Newkirk | F02M 26/19 123/529 |
| 4,135,481 | A | * | 1/1979 | Resler, Jr. | F02B 17/00 123/430 |

(Continued)

FOREIGN PATENT DOCUMENTS

WO 2013-055361 A1 4/2013

*Primary Examiner* — David Hamaoui
*Assistant Examiner* — Susan Scharpf

(57) ABSTRACT

An EGR device includes a housing and an inner pipe. The housing has an outer pipe. The inner pipe is accommodated in the outer pipe. The inner pipe defines an inner passage internally and defines an annular passage externally with the outer pipe. The inner pipe has through holes communicating the inner passage with the annular passage. At least one diffuser is equipped to the through holes. The diffuser is projected radially inward.

10 Claims, 12 Drawing Sheets

(56) References Cited

U.S. PATENT DOCUMENTS 4,461,150 A * 7/1984 Grohn ..... F02M 26/19 123/568.17
5,158,443 A * 10/1992 Miyake ..... F23D 11/105 239/399
5,207,714 A * 5/1993 Hayashi ..... F02M 26/18 123/568.17
6,267,106 B1 * 7/2001 Feucht ..... F02M 26/19 123/568.17
6,293,265 B1 * 9/2001 Gagnon ..... F02M 35/10222 123/568.17
6,343,594 B1 * 2/2002 Koeslin ..... F02M 26/19 123/568.11
6,418,723 B1 * 7/2002 Gladden ..... F02B 37/013 415/120
6,425,382 B1 * 7/2002 Marthaler ..... F02M 26/19 123/568.17
6,427,671 B1 * 8/2002 Holze ..... B01F 5/045 123/568.17
6,513,508 B2 * 2/2003 Fischer ..... F02M 35/10118 123/568.17
6,609,374 B2 * 8/2003 Feucht ..... F02D 9/104 123/568.17
6,672,292 B2 * 1/2004 Fischer ..... F02M 35/10118 123/568.17
7,028,680 B2 * 4/2006 Liu ..... F02M 35/10222 123/568.17
7,032,578 B2 * 4/2006 Liu ..... F02M 35/10118 123/568.15
7,140,357 B2 * 11/2006 Wei ..... F02B 29/0425 123/568.17
7,389,770 B2 * 6/2008 Bertilsson ..... F02M 26/40 123/568.17
7,568,340 B2 * 8/2009 Marsal ..... F02M 26/19 123/568.17
7,624,575 B2 * 12/2009 Noelle ..... F01D 25/24 60/605.1
8,056,340 B2 * 11/2011 Vaught ..... F02B 33/44 123/568.17
8,561,599 B2 * 10/2013 Gingrich ..... F02M 26/43 123/568.17
8,689,553 B2 * 4/2014 Johnson ..... F02D 9/02 123/568.17
9,410,504 B2 * 8/2016 Gerty ..... F02M 26/41
9,482,187 B2 * 11/2016 Cloos ..... F02M 26/19
2002/0148451 A1 * 10/2002 Yamamoto ..... F02M 21/0278 123/527
2004/0079347 A1 * 4/2004 Bender ..... F02M 35/10118 123/568.17
2006/0060173 A1 * 3/2006 Wei ..... F02B 29/0425 123/568.17
2007/0271920 A1 11/2007 Marsal et al.
2009/0107130 A1 * 4/2009 Emerick ..... B01F 3/02 60/324
2011/0061634 A1 * 3/2011 Sponsky ..... F02B 47/08 123/568.17
2011/0146635 A1 * 6/2011 Zeitoun ..... F02M 26/14 123/568.11
2011/0233436 A1 * 9/2011 Perr ..... F01N 3/031 251/207
2012/0180478 A1 7/2012 Johnson et al.
2012/0216530 A1 * 8/2012 Flynn ..... F02M 25/0722 60/605.2
2014/0102422 A1 * 4/2014 Prinz ..... F02M 21/047 123/527
2014/0246000 A1 * 9/2014 Cloos ..... F02M 26/19 123/568.17
2014/0331669 A1 * 11/2014 Jones ..... F02M 25/0722 60/605.2
2015/0267650 A1 * 9/2015 Siuchta ..... F02M 21/0215 60/605.2
2016/0024769 A1 * 1/2016 Zoller ..... E03C 1/084 239/407
2016/0160805 A1 * 6/2016 Polcyn ..... F02M 26/70 123/568.18
2016/0281650 A1 * 9/2016 Roth ..... F02M 26/19
2017/0022941 A1 * 1/2017 Mallard ..... F02M 26/19
2017/0254245 A1 * 9/2017 Zhang ..... F02M 26/19

* cited by examiner

| POSITION | P1 | P2 | P3 | P4 | P5 | P6 |
|---|---|---|---|---|---|---|
| TEMPERATURE (℃) | 60.8 | 72.4 | 73.7 | 74.1 | 72.9 | 67.2 |

| POSITION | P1 | P2 | P3 | P4 | P5 | P6 |
|---|---|---|---|---|---|---|
| TEMPERATURE (℃) | 60.8 | 72.4 | 73.7 | 74.1 | 72.9 | 67.2 |

EGR DEVICE HAVING DIFFUSER AND EGR MIXER FOR EGR DEVICE

TECHNICAL FIELD

The present disclosure relates to an EGR device having a diffuser for an internal combustion engine of a vehicle. The present disclosure further relates to an EGR mixer for the EGR device.

BACKGROUND

A vehicle may be equipped with an exhaust gas recirculation system (EGR system). The EGR system is to reduce emission contained in exhaust gas discharged from an internal combustion engine. The EGR system may recirculate a part of exhaust gas into fresh air to produce mixture gas containing recirculated exhaust gas and fresh air. Recirculated exhaust gas may be unevenly mixed with fresh air to reduce combustion efficiency of the engine consequently.

SUMMARY

The present disclosure addresses the above-described concerns.

According to an aspect of the preset disclosure, an EGR device comprises a housing having an outer pipe. The EGR device further comprises an inner pipe accommodated in the outer pipe. The inner pipe defines an inner passage internally. The inner pipe defines an annular passage externally with the outer pipe. The inner pipe has a plurality of through holes communicating the inner passage with the annular passage. At least one diffuser is equipped to the through holes. The at least one diffuser is projected radially inward.

According to another aspect of the preset disclosure, an EGR mixer is for an EGR device. The EGR mixer is configured to be accommodated in an outer pipe of the EGR device to define an annular passage with the outer pipe. The EGR mixer comprises a pipe body having a plurality of through holes communicated with the annular passage. The EGR mixer comprises a plurality of diffusers equipped to the through holes, respectively. The diffusers are arranged along a circumferential direction of the pipe body and projected radially inward. At least one of the diffuser is in a conical shape having a plurality of apertures.

BRIEF DESCRIPTION OF THE DRAWINGS

The above and other objects, features and advantages of the present invention will become more apparent from the following detailed description made with reference to the accompanying drawings. In the drawings:

FIGS. 12 to 14 are sectional views showing a diffuser according to fifth to seventh embodiments.

DETAILED DESCRIPTION

First Embodiment

Figure 1:
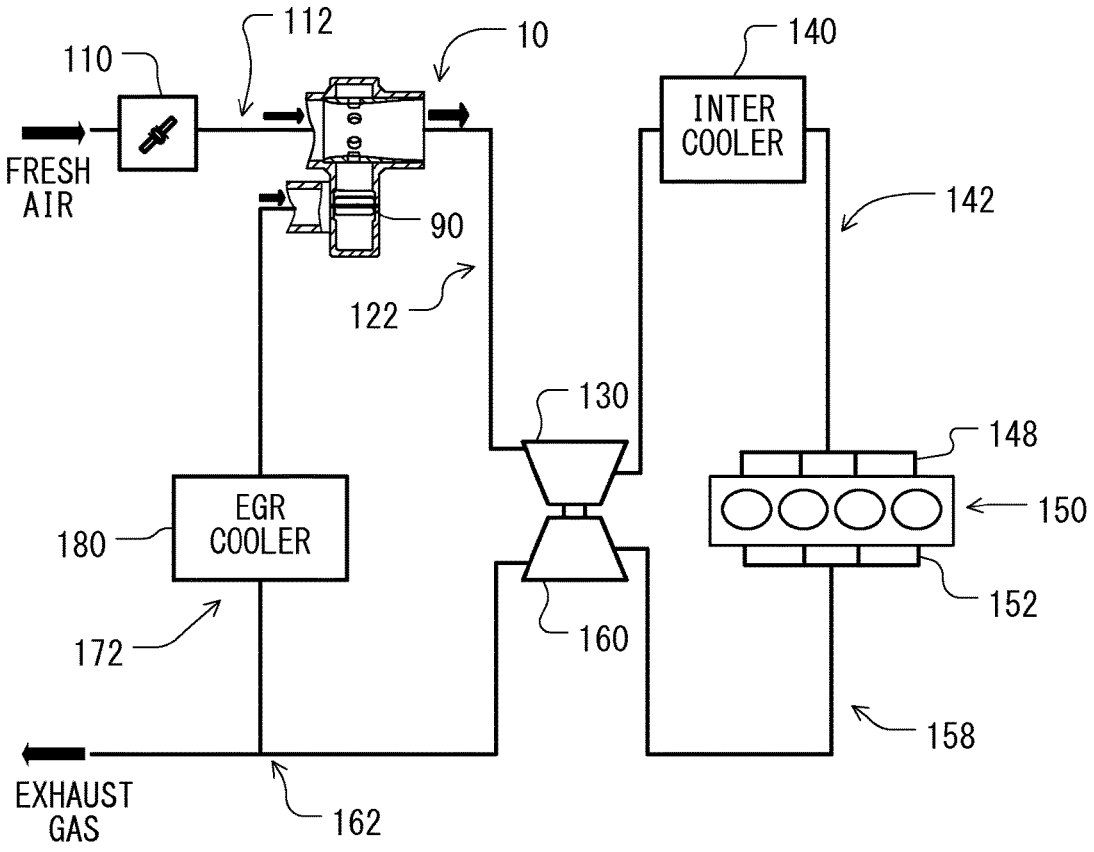
FIG. 1 is a block diagram showing an EGR system for an internal combustion engine of a vehicle.

In the following description, a radial direction is along an arrow represented by "RADIAL" in drawing(s). An axial direction is along an arrow represented by "AXIAL" in drawing(s). A thickness direction is along an arrow represented by "THICKNESS" in drawing(s). A circumferential direction is along an arrow represented by "CIRCUMFERENTIAL" in drawing(s). A flow direction is along an arrow represented by "FLOW" in drawing(s).

As follows, a first embodiment of the present disclosure will be described with reference to FIGS. 1 to 8B. As shown FIG. 1, according to the present example, an internal combustion engine 150 has four cylinders connected with an intake manifold 148 and an exhaust manifold 152.

The engine 150 is combined with an intake and exhaust system. The intake and exhaust system includes an intake valve 110, an intake passage 112, an EGR device 10, a mixture passage 122, a turbocharger including a compressor 130 and a turbine 160, a charge air passage 142, and an intercooler 140. The intake and exhaust system further includes a combustion gas passage 158, an exhaust passage 162, an EGR passage 172, and an EGR cooler 180.

The intake passage 112 is equipped with the intake valve 110. The intake passage 112 is connected with the EGR device 10. The EGR device 10 is connected with the compressor 130 through the mixture passage 122. The compressor 130 is connected with the intake manifold 148 through the charge air passage 142. The charge air passage 142 is equipped with the intercooler 140. The exhaust manifold 152 is connected with the turbine 160 through the combustion gas passage 158. The turbine 160 is connected with the exhaust passage 162. The EGR passage 172 is branched from the exhaust passage 162 and connected with the EGR device 10. The EGR passage 172 is equipped with the EGR cooler 180.

The intake passage 112 conducts fresh air from the outside of the vehicle through the intake valve 110 into the EGR device 10. The intake valve 110 regulates a quantity of fresh air flowing through the intake passage 112 into the EGR device 10. The EGR device 10 draws fresh air from the intake passage 112 and draws exhaust gas from the exhaust passage 162 through the EGR passage 172. The EGR device 10 includes an EGR mixer to blend the drawn fresh air with the drawn exhaust gas to produce mixture gas. The mixture passage 122 conducts the mixture gas from the EGR device 10 into the compressor 130.

The compressor 130 is rotatably connected with the turbine 160 via a common axis. The compressor 130 is driven by the turbine 160 to compress the mixture gas. The charge air passage 142 conducts the compressed mixture gas to the intake manifold 148. The intercooler 140 is a heat exchanger to cool the compressed mixture gas conducted through the charge air passage 142.

The engine 150 draws the cooled mixture gas. The engine 150 forms air-fuel mixture with the drawn mixture gas and injected fuel in each cylinder and burns the air-fuel mixture in the cylinder to drive a piston in the cylinder. The engine 150 emits combustion gas (exhaust gas) through the exhaust manifold 152 into the combustion gas passage 158. The combustion gas passage 158 conducts the combustion gas into the turbine 160. The turbine 160 is driven by the exhaust gas to drive the compressor 130 thereby to cause the compressor 130 to compress mixture gas and to press-feed the compressed mixture gas through the charge air passage 142 and the intercooler 140 into the engine 150.

The exhaust passage 162 conducts exhaust gas (combustion gas) from the turbine 160 to the outside of the vehicle. The EGR passage 172 is branched from the exhaust passage 162 at the downstream side of the turbine 160 to recirculate a part of exhaust gas from the exhaust passage 162 into the EGR device 10. The EGR cooler 180 is a heat exchanger to cool exhaust gas flowing though the EGR passage 172 into the EGR device 10. The EGR device 10 is located at a connection among the intake passage 112, the EGR passage 172, and the mixture passage 122. The EGR passage 172 is merged with the intake passage 112 in the EGR device 10. The EGR device 10 includes an EGR valve 90 to regulate a quantity of EGR gas recirculated into the EGR mixer.

As described above, the EGR system is configured to recirculate a part of exhaust gas from the exhaust passage 162 into the intake passage 112. The circulated exhaust gas may contain oxygen at a lower percentage compared with oxygen contained in fresh air. Therefore, circulated exhaust gas may dilute mixture of exhaust gas and fresh air thereby to reduce peak temperature of combustion gas when burned in the combustion chamber of the engine 150. In this way, the EGR system may reduce oxidization of nitrogen, which is caused under high temperature, thereby to reduce nitrogen oxide (NOx) occurring in the combustion chamber.

Figure 2:
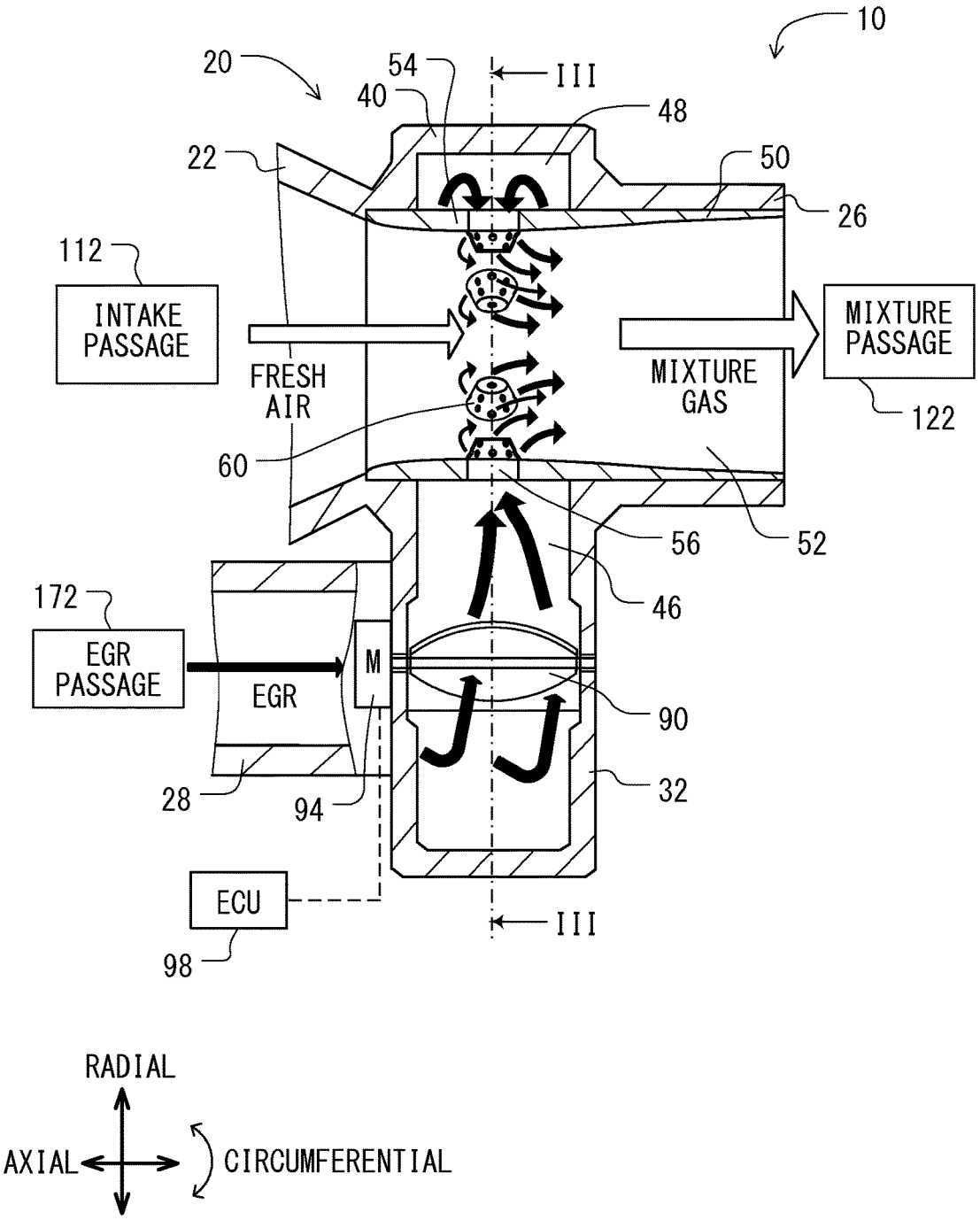
FIG. 2 is a sectional view showing an EGR device for the EGR system, according to a first embodiment.
Figure 3:
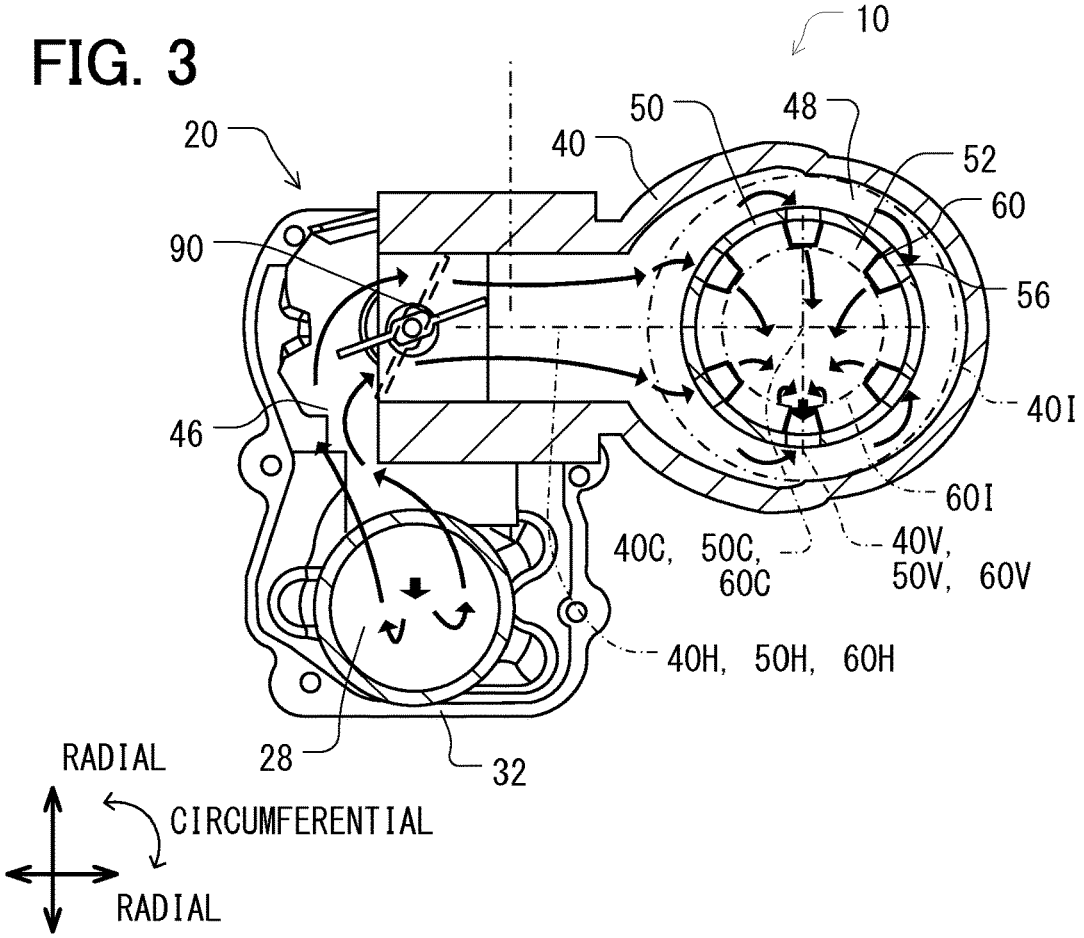
FIG. 3 is a sectional view showing the EGR device, the sectional view corresponding to a section taken along the line III-III in FIG. 2.
Figure 4:
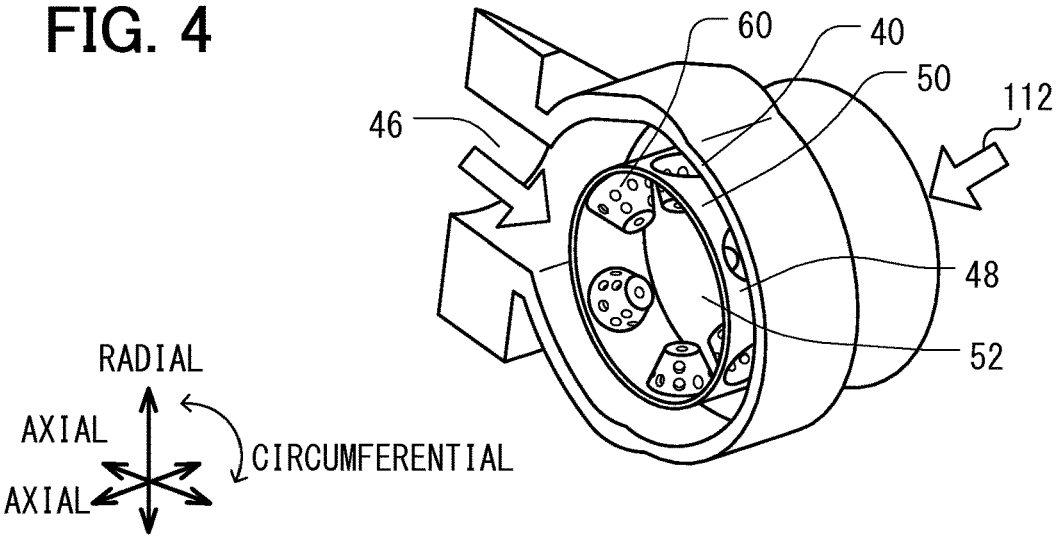
FIG. 4 is a perspective view showing a section of the EGR device.

Subsequently, the configuration of the EGR device 10 will be described in detail. As shown in FIGS. 2 to 4, the EGR device 10 includes a housing 20 accommodating an inner pipe (EGR mixer, pipe body) 50, the EGR valve 90, and a motor 94. The housing 20, the inner pipe 50, and the EGR valve 90 are formed of a metallic material such as stainless steel and/or an aluminum alloy.

The housing 20 includes an air inlet 22, an outer pipe 40, an outlet 26, an EGR inlet 28, and an EGR guide 32. The air inlet 22 is connected with the intake passage 112. The outlet 26 is connected with the mixture passage 122. The outer pipe 40 is located between the air inlet 22 and the outlet 26. The outer pipe 40 is greater than both the air inlet 22 and the outlet 26 in inner diameter to form an annular groove extending in the circumferential direction.

The inner pipe 50 is in a tubular shape and is inserted in the housing 20. The inner pipe 50 is affixed to the housing 20 by, for example, welding. The inner pipe 50 has an outer periphery, which defines an annular passage 48 with an inner periphery of the outer pipe 40. The annular passage 48 extends in the circumferential direction. The inner pipe 50 has an inner periphery, which defines an inner passage 52 communicated with the intake passage 112 and the mixture passage 122. The inner pipe 50 has an inner periphery defining a curvature to reduce the inner passage 52 at an intermediate portion 54 in the axial direction. The intermediate portion 54 forms a throttle radially inward.

The inner pipe 50 has multiple through holes 56, which are arranged along the circumferential direction. According to the present example, the inner pipe 50 has six through holes 56, which are arranged substantially at constant angular intervals, such as 60-degree intervals. Each of the through holes 56 extends along the radial direction through an inner wall of the inner pipe 50. The through hole 56 is directed substantially at 90 degrees relative to a center axis of the inner pipe 50.

Figure 5:
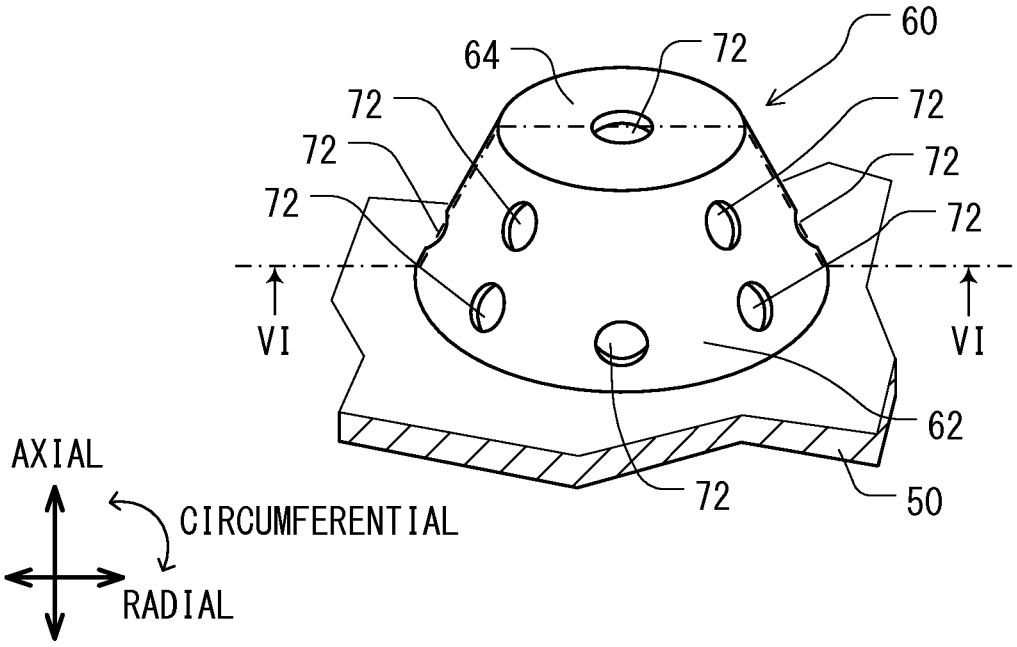
FIG. 5 is a perspective view showing a diffuser of the EGR device.
Figure 6:
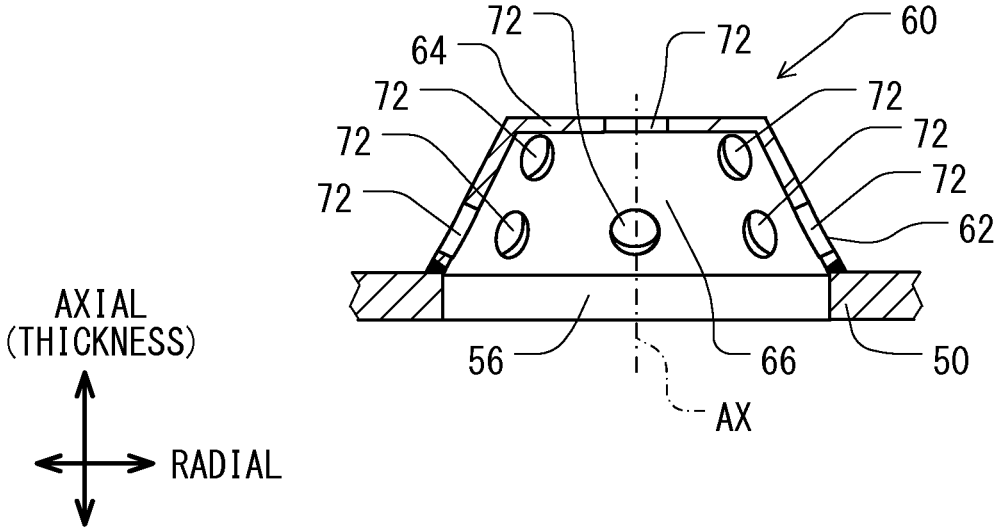
FIG. 6 is a sectional view showing the diffuser and taken along the line VI-VI in FIG. 5.

The through holes 56 are equipped with the diffusers 60 respectively. Each of the diffusers 60 is substantially in a conical shape having apertures 72 (FIGS. 5 and 6). The diffusers 60 are projected from the inner periphery of the inner pipe 50 inward in the radial direction. The diffusers 60 are arranged in the circumferential direction in a form of a circular array.

The EGR inlet 28 is connected with the EGR passage 172. The EGR inlet 28 is communicated with an EGR channel 46 defined in the EGR guide 32. The EGR channel 46 is configured to be communicated with the annular passage 48.

The EGR valve 90 is, for example, a butterfly valve having a shaft, which is rotatably supported by bearings at both ends. Thus, the EGR valve 90 is rotatably equipped in the EGR guide 32 and is variable in rotational position to control an opening area of the EGR channel 46. The EGR valve 90 is rotatable between a full close position and a full open position. The EGR valve 90 is at the full close position when being at the position represented by dotted line in FIG. 3. The motor 94 (FIG. 2) is equipped to one end of the shaft to drive the EGR valve 90. An electronic control unit (ECU) 98 is electrically connected with the motor 94 to control electricity supplied to the motor 94 thereby to control the rotation angle of the valve. The motor 94 may be equipped with a hall sensor (not shown) to detect the rotation angle and to send a signal representing the detected rotation angle to the ECU 98.

The present configuration enables to flow EGR gas from the EGR passage 172 to pass through the EGR channel 46 and to pass around the EGR valve 90. The present configuration further enables to flow EGR gas to pass through the annular passage 48 circumferentially and further to flow the EGR gas into the inner passage 52 radially inward through the through holes 56 and the apertures 72 of the diffusers 60. The annular passage 48 leads EGR gas to flow from the EGR channel 46 and to flow entirely around the outer periphery of the inner pipe 50 toward the opposite side of the EGR channel 46. Thus, the annular passage 48 may enable to distribute EGR gas evenly around the inner pipe 50 in the circumferential direction. The ECU 98 is configured to control the position of the EGR valve 90 to manipulate a quantity of EGR gas flowing through the EGR channel 46 into the annular passage 48.

In FIG. 2, the curvature defined by the inner periphery of the inner pipe 50 may be configured to throttle the inner passage 52 and to cause Venturi effect at the intermediate portion 54. The curvature may be configured to increase flow velocity of fresh air and to cause negative pressure at the intermediate portion 54. Thus, the curvature may facilitate to induce EGR gas from the annular passage 48 on the radially outside of the inner pipe 50 into the inner passage 52 through the through holes 56. In this way, the curvature may facilitate to feed EGR gas into the inner passage 52 and to blend the EGR gas with fresh air.

The inner pipe 50 has a cross section having a vertical center 50V, a horizontal center 50H, and a center point 50C, which is an intersection between the vertical center 50V and the horizontal center 50H. The inner periphery of the outer pipe 40 has a cross section defining an inscribe circle 40I, which has a vertical center 40V, a horizontal center 40H, and a center point 40C, which is an intersection between the vertical center 40V and the horizontal center 40H. The diffusers 60, which are in the form of the circular array, have cross sections defining an inscribe circle 60I, which has a vertical center 60V, a horizontal center 60H, and a center point 60C, which is an intersection between the vertical center 60V and the horizontal center 60H.

In the present example, as shown in FIG. 3, the circular array of the diffusers 60, the inner pipe 50, and the outer pipe 40 are substantially coaxial with each other. Specifically, the center point 50C of the inner pipe 50, the center point 40C of the inscribe circle 40I of the outer pipe 40, and the center point 60C of the inscribe circle 60I of the diffusers 60 substantially coincide with each other.

The diffusers 60 are projected radially inward from the inner periphery of the intermediate portion 54 of the inner pipe 50. Therefore, the diameter of the inscribe circle 60I of the diffusers 60 is less than the diameter of the cross section of the inner periphery of the inner pipe 50. The diffusers 60 may be configured further to throttle the inner passage 52 at the intermediate portion 54 and further to cause Venturi effect at the intermediate portion 54. The diffusers 60 may further facilitate to induce EGR gas into the inner passage 52.

FIGS. 5 and 6 show representative one of the diffusers 60. The diffusers 60 may have a common configuration to each other. Alternatively, diffusers 60 may have different configurations in consideration of, for example, desirable distribution of EGR gas.

The diffuser 60 is substantially in a conical shape, such as a chamfered conical shape. The diffuser 60 has a sidewall 62 and a top wall 64. The sidewall 62 reduces in diameter from the side of the inner pipe 50 toward the top wall 64.

The diffuser 60 may be formed by, for example, drawing a metallic plate into the conical shape, cutting the drawn diffuser 60 from the metallic plate, and forming the apertures 72 by drilling or punching the top wall 64 and the sidewall 62. Alternatively, the diffuser 60 may be formed by machining work. The diffuser 60 may be formed by, for example, injection molding a metallic material or a resin material. The diffuser 60 may be welded on the inner periphery of the inner pipe 50 to cover the through hole 56 from the radially inside. The diffuser 60 and the through hole 56 may be coaxial to have a common center axis 70AX. The diffuser 60 has an inner periphery extending smoothly from an inner periphery of the through hole 56.

In the present example, the top wall 64 has one aperture 72 at a center, and the sidewall 62 has twelve apertures 72. More specifically, the apertures 72 in the sidewall 62 are located at the constant interval, such as 45 degrees, in the circumferential direction. Two apertures 72 and one aperture 72 are alternatively arranged in the circumferential direction. The two apertures 72 are arranged along the thickness direction. The apertures 72 may have the same diameter or may have different diameters. In the present example, each aperture 72 is in a circular shape.

The diffuser 60 defines an inner space 66 reduced toward the top wall 64 to throttle EGR gas flowing from the through hole 56. Each aperture 72 extends through the top wall 64 or the sidewall 62 to form a throttle. The present configuration enables to flow EGR gas from the outside of the inner pipe 50 through each through hole 56, the inner space 66 of each diffuser 60, and each aperture 72 into the inner passage 52 (FIG. 2). After passing through the aperture 72, EGR gas may be expanded and diffused into fresh air passing through the inner passage 52. Thus, the present configuration may enable EGR gas to be homogeneously and evenly blended with fresh air in the inner passage 52 to produce uniform mixture gas.

As follows, simulation results of EGR gas and EGR mixture in the EGR device 10 will be described with reference to FIGS. 7A and 7B and FIGS. 8A and 8B. According to the condition of the simulation, temperature of EGR gas is at 155 degree Celsius, and temperature of fresh air is 20 degree Celsius. The simulated position in the inner passage 52 is at about 40 mm downstream of the diffusers 60.

Figure 7A:
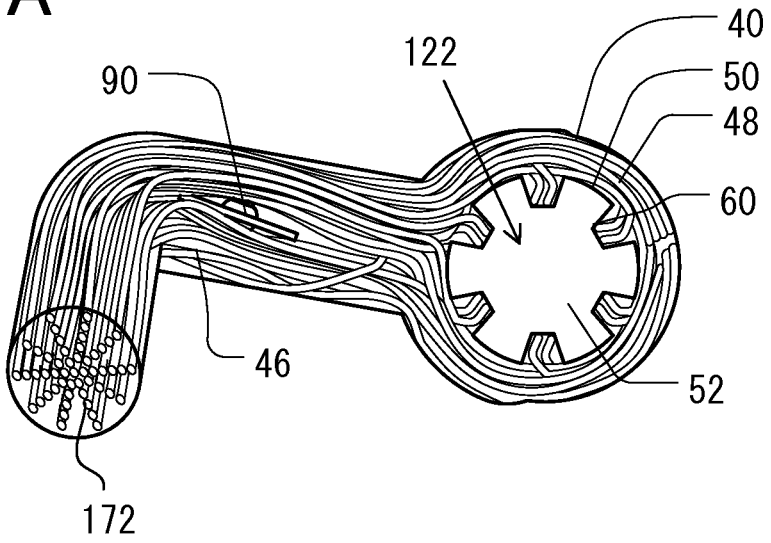
FIGS. 7A and 7B are views showing a first result of a computational fluid dynamics (CFD) analysis of the EGR device.
Figure 7B:
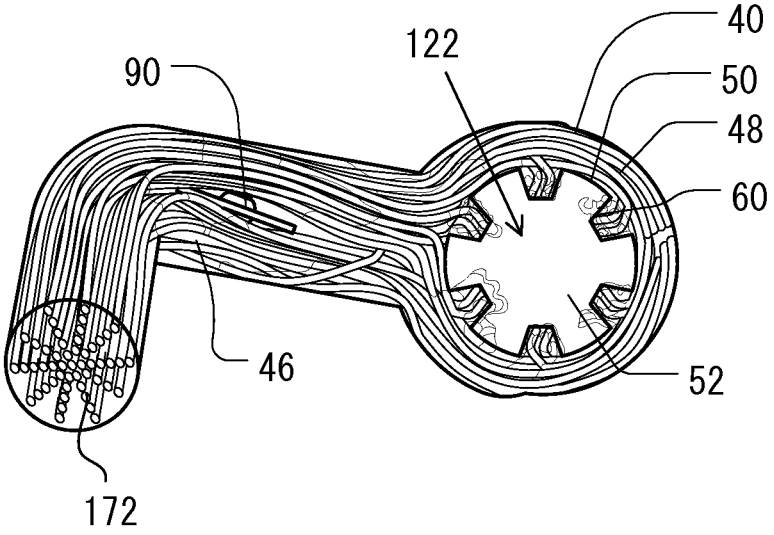
Figure 7B:
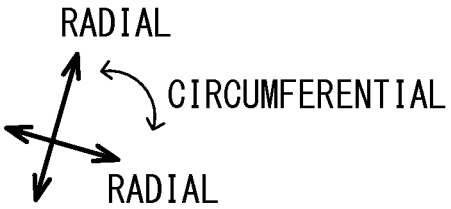

FIGS. 7A and 7B shows a simulation result representing flows of EGR gas in the EGR device 10. EGR gas passes through the EGR channel 46, the annular passage 48, the through holes 56, and the diffusers 60 and flows into the inner passage 52. As shown in FIGS. 7A and 7B, the annular passage 48 effectively leads EGR gas from the EGR channel 46 through the annular passage 48 toward the opposite side of the EGR channel 46. In addition, EGR gas is evenly distributed to the diffusers 60 through the through holes 56.

Figure 8A:
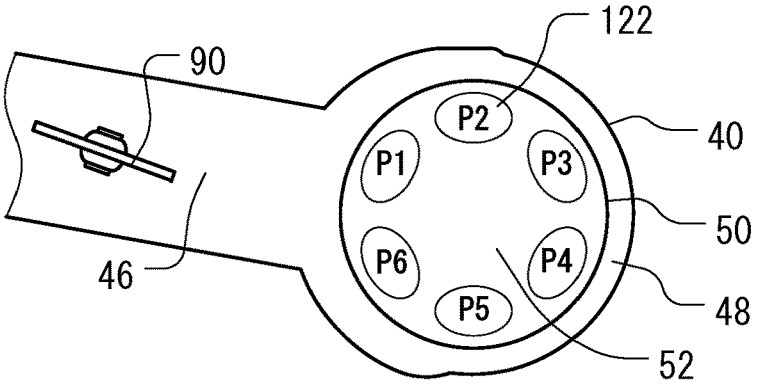
FIGS. 8A and 8B are views showing a second result of a computational fluid dynamics (CFD) analysis of the EGR device.
Figure 8B:
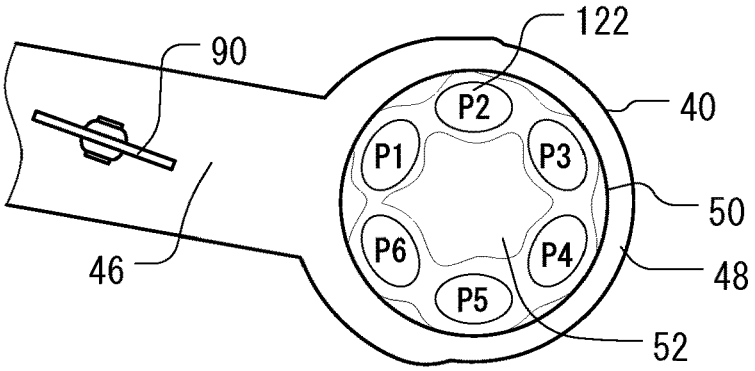
Figure 8B:
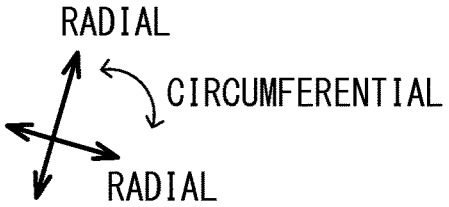

FIGS. 8A and 8B shows a simulation result representing distribution of temperature of mixture gas in the inner passage 52 at the downstream of the diffusers 60. At points P1, P2, P3, P4, P5, P6, mixture gas passing through the inner passage 52 has a temperature distribution within a range between 60.8 degree Celsius and 74.1 degree Celsius. That is, the EGR device 10 may effectively distributes EGR gas through the annular passage 48 and produces EGR mixture through the diffusers 60 entirely in the circumferential direction.

Second Embodiment

Figure 9:
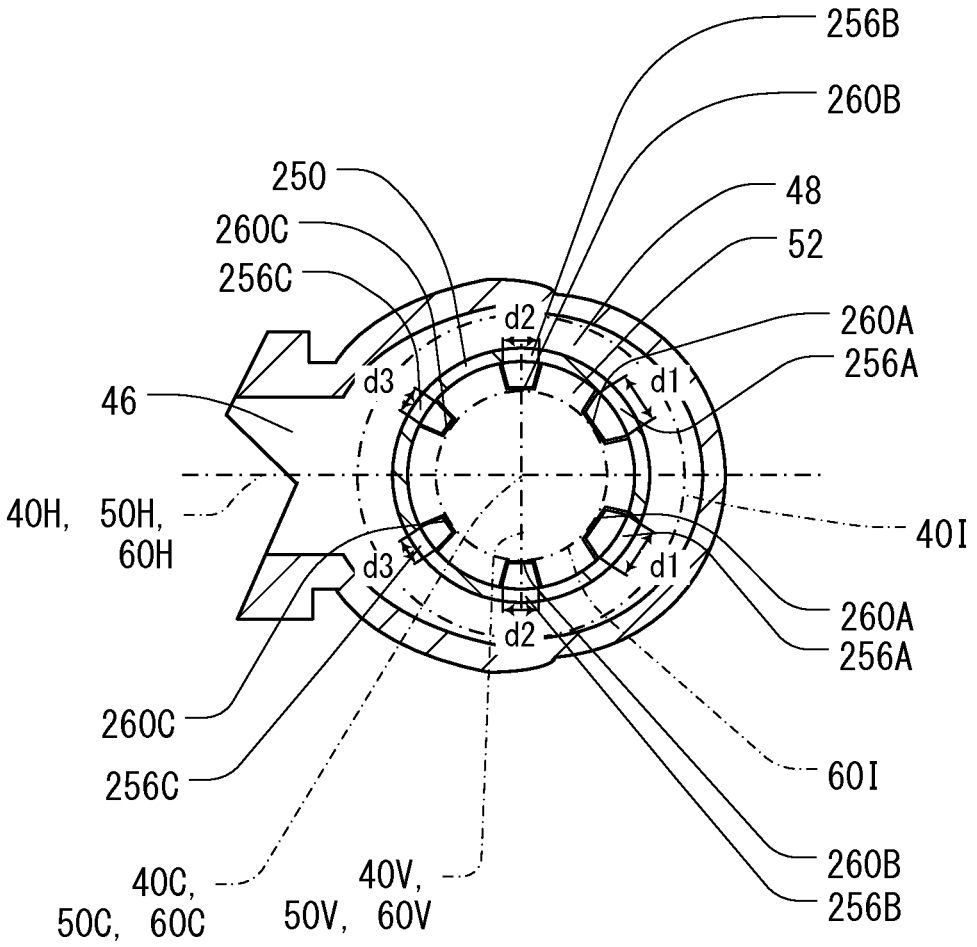
FIGS. 9 to 13 are sectional views showing an EGR device according to second to fourth embodiments.
Figure 9:
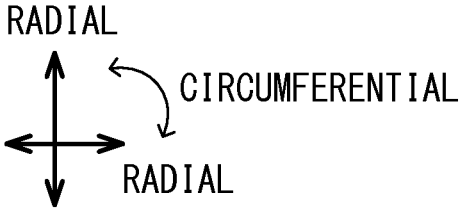

As shown in FIG. 9, according to the present second embodiment, an inner pipe 250 has through holes and diffusers, which have different diameters. Specifically, through holes 256A, 256B, 256C and diffusers 260A, 260B, 260C are formed to have diameters increased from the side of the EGR channel 46 toward the opposite side of the EGR channel 46. More specifically, the through holes 256A and the diffusers 260A have an inner diameter d1. The through holes 256B and the diffusers 260B have an inner diameter d2. The through holes 256C and the diffusers 260C have an inner diameter d3. The diameters d1, d2, d3 satisfy the following relation: d1>d2>d3.

The diffusers 260A, 260B, 260C have substantially the same heights to form the inscribe circle 60I at the top walls. In the present example, similarly to the first embodiment, the circular array of the diffusers 260A, 260B, 260C, the inner pipe 250, and the outer pipe 40 are substantially coaxial with each other. Specifically, the center point 50C of the inner pipe 250, the center point 40C of the inscribe circle 40I of the outer pipe 40, and the center point 60C of the inscribe circle 60I of the diffusers 260A, 260B, 260C substantially coincides substantially coincide with each other.

Modification of Second Embodiment

The second embodiment may employ diffusers being analogous to each other in shape and are different from each other in size. Specifically, the diffusers may be formed to have the diameters and the height both increased from the side of the EGR channel 46 toward the opposite side of the EGR channel 46, correspondingly to the increase in the diameter of the through holes.

Third Embodiment

Figure 10:
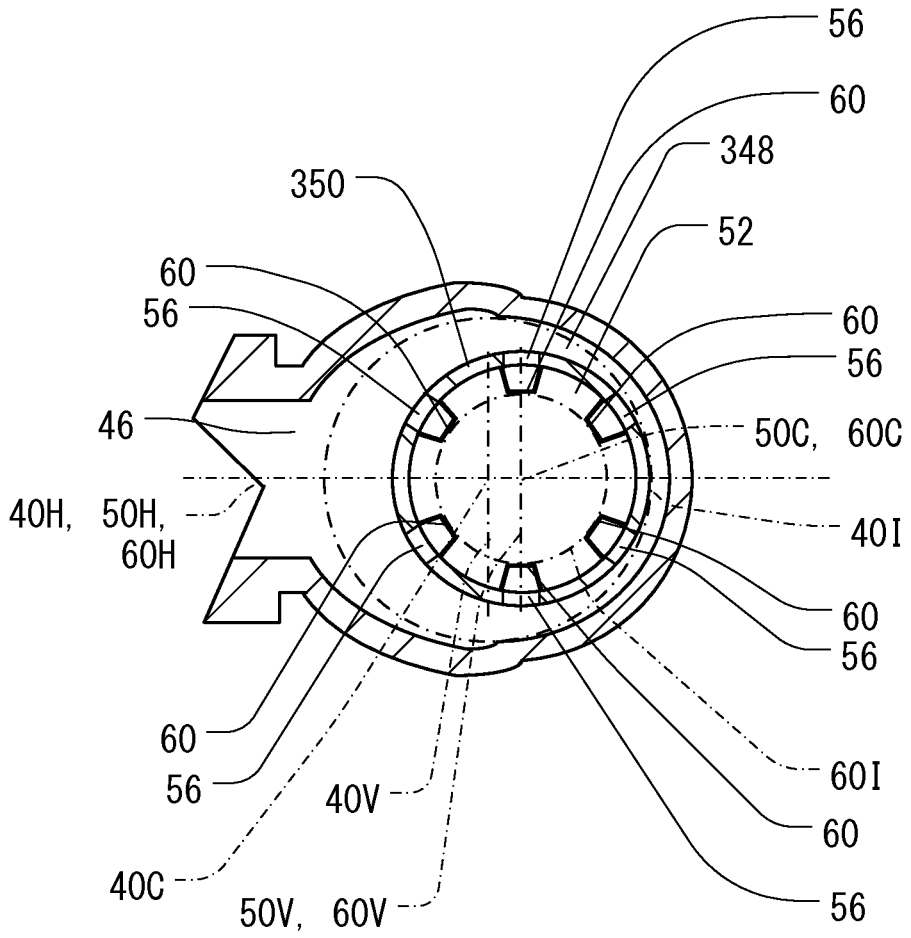
Figure 10:
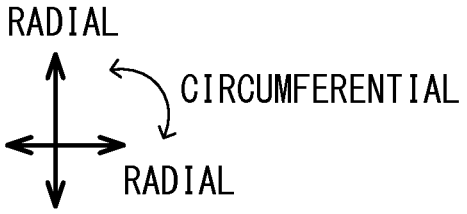

As shown in FIG. 10, according to the present third embodiment, an inner pipe 350 is offset relative to the outer pipe 40, such that the vertical center 40V of the outer pipe 40 is offset from the vertical center 50V of the inner pipe 50 in the radial direction. More specifically, the outer pipe 40 and the inner pipe 50 may be offset in relation to each other so that a distance between the outer pipe 40 and the inner pipe 50 progressively decreases from the EGR channel 46 to the opposite side of the EGR channel 46. Therefore, an annular passage 348 formed between the outer pipe 40 and the inner pipe 350 is gradually reduced in passage area toward the opposite side of the EGR channel 46.

Fourth Embodiment

Figure 11:
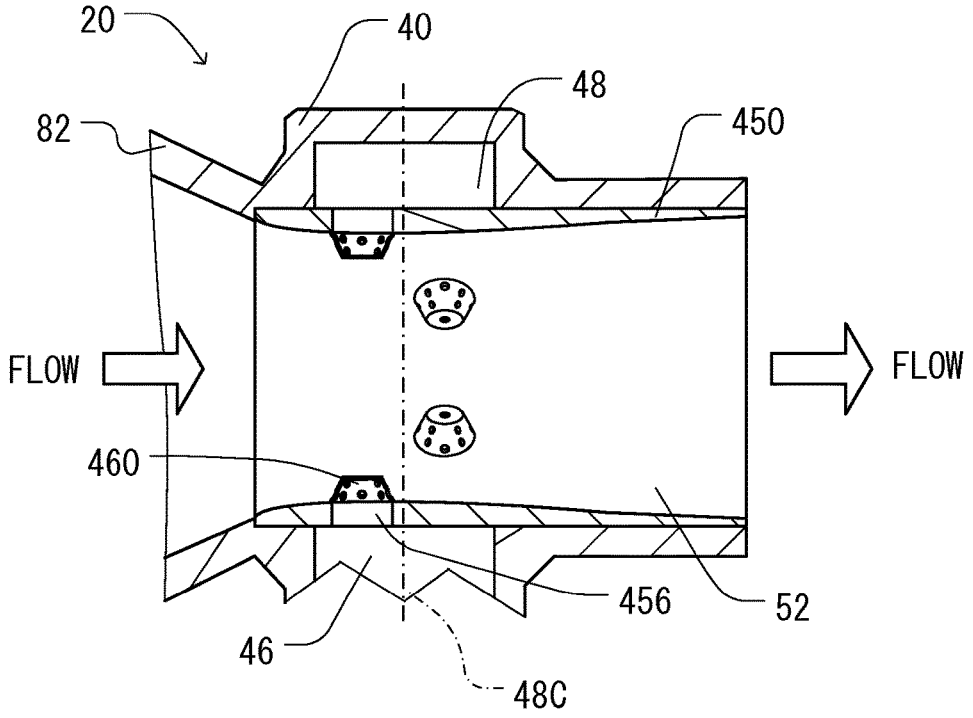
Figure 11:
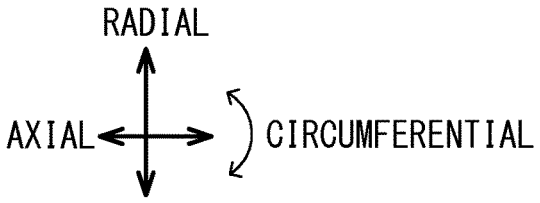

In FIG. 11, bold arrows show the flow of fresh air on the upstream side of diffuser 460 and the flow of mixture gas on the downstream side of the diffuser 460. As shown in FIG. 11, according to the present fourth embodiment, an inner pipe 450 is equipped with two diffusers 460 arranged on the upstream side of a centerline 48C of the annular passage 48. In addition, in FIG. 11, which is the sectional view, two diffusers 460 are arranged on the downstream side of the centerline 48C of the annular passage 48. That is, in the entire circumferential direction, four diffusers 460 are arranged on the downstream side in total. In the present configuration, two diffusers 460 and one diffuser 460 are arranged alternately in the circumferential direction. That is, the two diffusers 460 and the one diffuser 460 are arranged alternately relative to the axial direction of the inner pipe 50. It is noted that, the diffusers 460 may be arranged alternately one another in the circumferential direction.

Fifth to Seventh Embodiments

Figure 12:
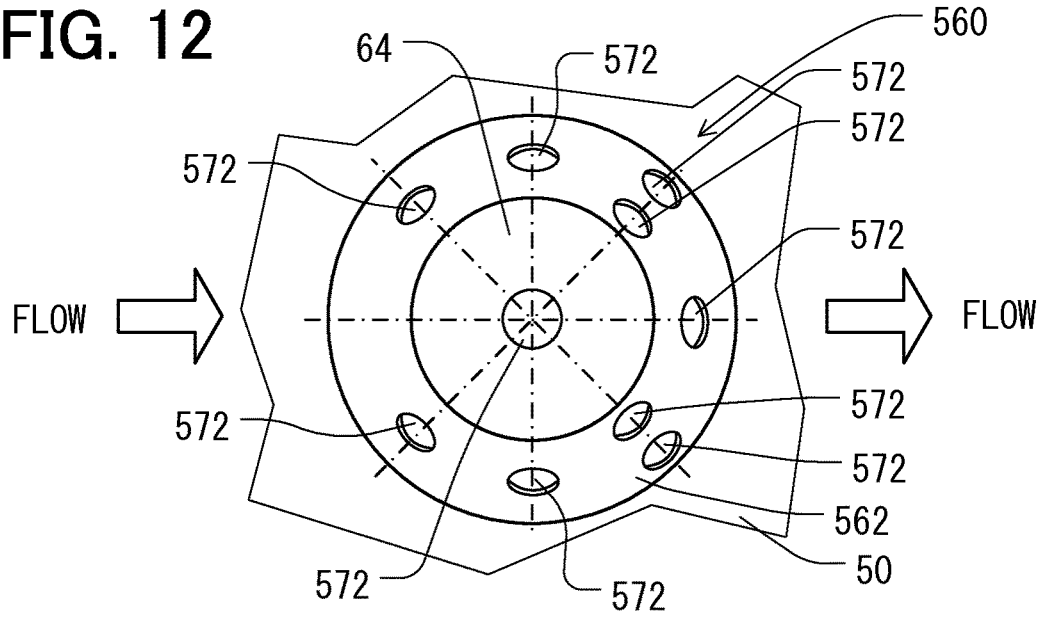
Figure 13:
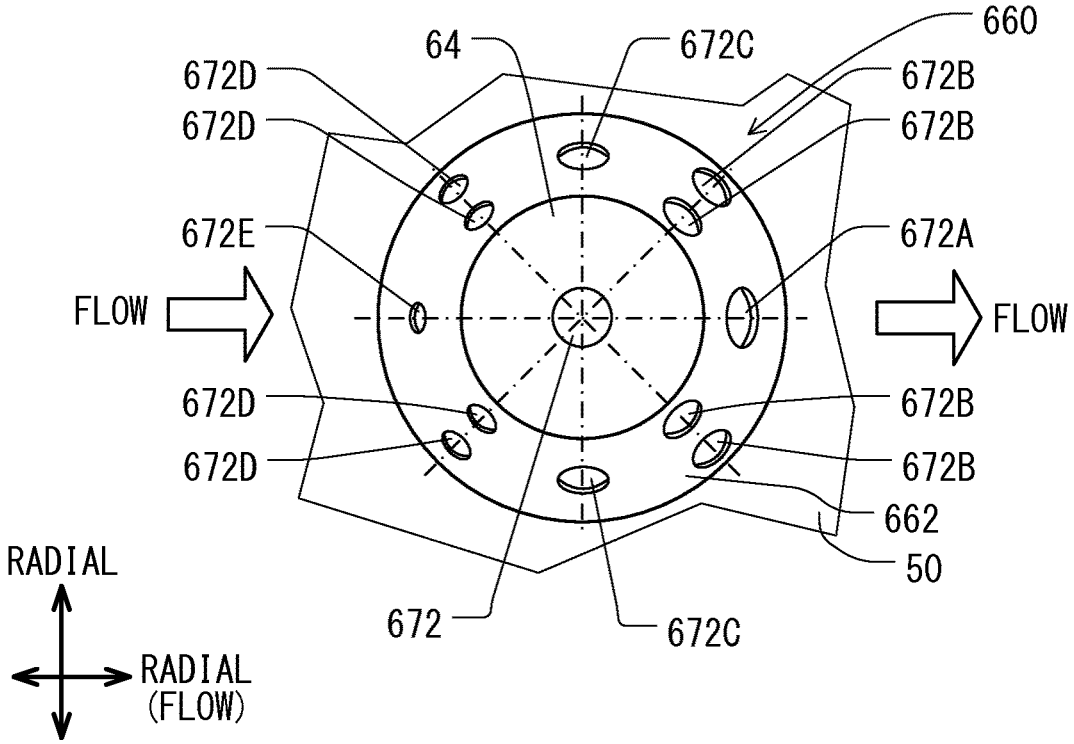
Figure 14:
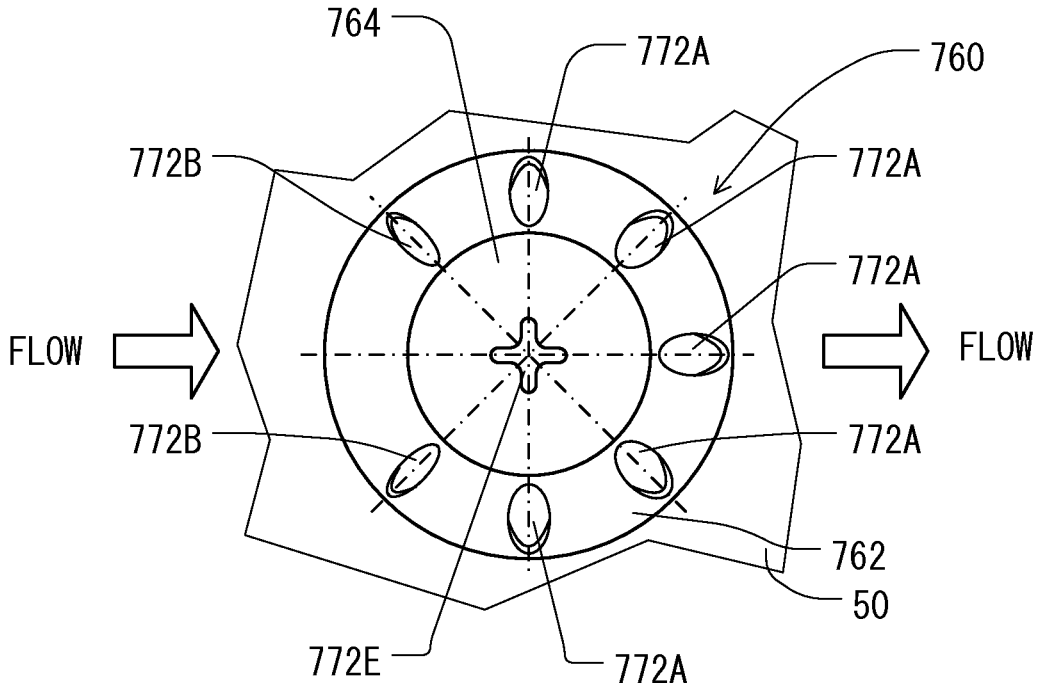
Figure 14:
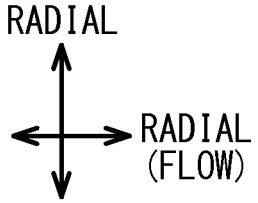

In FIGS. 12 to 14, bold arrows show the flow of fresh air on the upstream side of the diffuser 60 and the flow of mixture gas on the downstream side of the diffuser 60. Dashed lines show centerlines, which are centered on a center point of the diffuser and at 45 degrees angular intervals.

As shown in FIG. 12, according to the present fifth embodiment, a diffuser 560 has a sidewall 562 having nine apertures 572. In the present example, the apertures 572 are substantially identical to each other in size and shape. More specifically, the sidewall 562 has two apertures 572 on the upstream side at about 45 degrees relative to the flow. The sidewall 562 has two apertures 572 substantially at a right angle relative to the flow. The sidewall 562 has four apertures 572 on the downstream side at about 45 degrees relative to the flow. The sidewall 562 has one aperture 572 on the downstream side. The top wall 64 has one aperture 572. According to the present embodiment, the number of apertures 572 on the downstream side is greater than the number of apertures 572 on the upstream side.

As shown in FIG. 13, according to the present sixth embodiment, a diffuser 660 has a sidewall 662 having twelve apertures 672A, 672B, 672C, 672D, 672E. In the present example, the apertures 672A, 672B, 672C, 672D, 672E are increased in size from the upstream side to the downstream side. The top wall 64 has an aperture 672. According to the present embodiment, a total opening area of the apertures 672 on the downstream side is greater than a total opening area of the apertures 672 on the upstream side.

As shown in FIG. 14, according to the present seventh embodiment, a diffuser 760 has a sidewall 762 having seven apertures 772A, 772B. In the present example, each of the apertures 772A, 772B is an oval slit extending radially along a projected direction of the diffuser 760. Two apertures 772B on the upstream side are smaller than the other five apertures 772A in width. According to the present embodiment, the total opening area of the apertures 772A on the downstream side is greater than the total opening area of the apertures 772B on the upstream side. A top wall 764 has an aperture 772E in a plus-shape.

Eighth Embodiment

Figure 15:
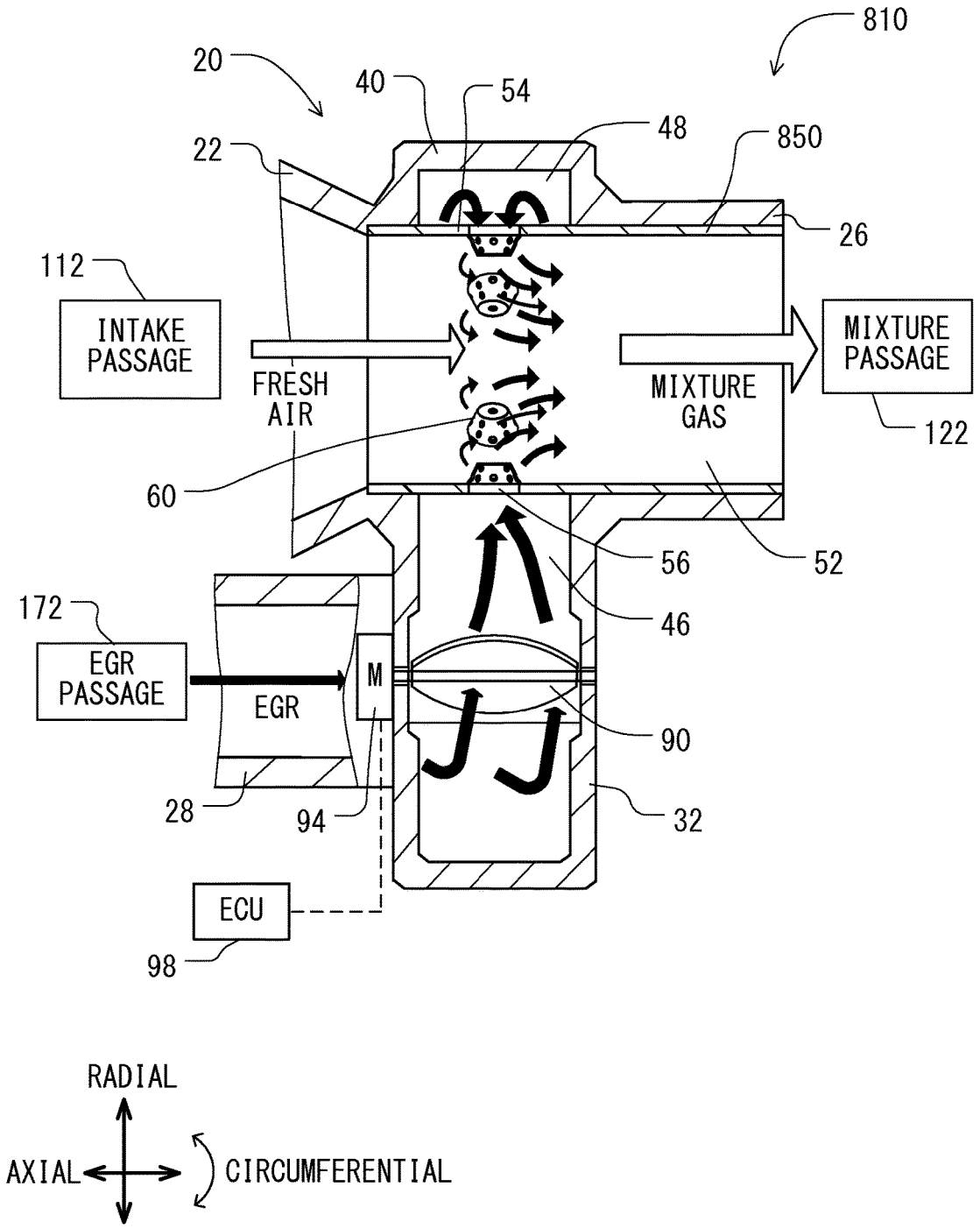
FIG. 15 is a sectional view showing an EGR device for the EGR system, according to an eight embodiment.

As shown in FIG. 15, according to the present eighth embodiment, an EGR device includes an inner pipe 850 having an inner periphery extending linearly in the axial direction. That is, the inner pipe 850 does not have the curvature on the inner periphery described in the first embodiment. Even in the present configuration, the diffusers 60 may form the throttle and may function to induce EGR gas.

Other Embodiment

The diffusers and the apertures may employ various forms. For example, the diffusers and the apertures may employ various numbers, various sizes, various arrangements, and/or various shapes. For example, the diffuser may employ various shapes such as a dome shape or a tubular shape. For example, the apertures may employ various shapes such as an oval shape, a polygonal shape, or a star shape. Various combinations of the apertures and diffusers of the above-described embodiments may be arbitrary employed.

The through holes and the diffusers may be unevenly arranged. For example, the through holes and the diffusers may be concentrically equipped to the opposite side of the EGR channel.

The through hole(s) and the conical diffuser(s) on the side of the EGR channel may be omitted. The aperture on the top wall may be omitted.

The EGR device may not have the EGR valve. The EGR valve may be equipped separately from the EGR device. The EGR device and/or the EGR device may be equipped downstream the turbocharger.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An EGR device comprising:

a housing having an outer pipe; and an inner pipe accommodated in the outer pipe, wherein the inner pipe defines an inner passage internally, the inner pipe defines an annular passage externally with the outer pipe, the inner pipe has a plurality of through holes communicating the inner passage with the annular passage, at least one diffuser is equipped to the through holes, and the at least one diffuser is in a conical shape having a plurality of apertures and extends radially inward into the inner passage from an inner periphery of the inner pipe wherein, each of the at least one diffuser has a sidewall extending in a circumferential direction of the at least one diffuser, the sidewall defines an inner space that is reduced toward a tip end, the diffuser further has a top wall at the tip end, and the top wall has at least one of the apertures.

2. The EGR device according to claim 1, wherein the at least one diffuser includes a plurality of diffusers, and the diffusers are arranged along a circumferential direction of the inner pipe.

3. The EGR device according to claim 1, wherein the apertures are arranged in the sidewall along a circumferential direction of the at least one diffuser.

4. The EGR device according to claim 1, wherein the inner pipe has an inner periphery defining a curvature, and the inner pipe has an intermediate portion projected radially inward to throttle the inner passage.

5. The EGR device according to claim 4, wherein the at least one diffuser is located at the intermediate portion.

6. The EGR device according to claim 2, wherein the diffusers form a circular array, and the circular array is coaxial with the inner pipe.

7. The EGR device according to claim 2, wherein at least one of the diffusers on an upstream side is smaller than at least one of an other of the diffusers.

8. The EGR device according to claim 1, wherein at least one of the apertures on an upstream side is smaller than at least one of another of the apertures on a downstream side.

9. The EGR device according to claim 1, wherein a number of the apertures on an upstream side is smaller than a number of the apertures on a downstream side.

10. An EGR mixer for an EGR device, the EGR mixer configured to be accommodated in an outer pipe of the EGR device to define an annular passage with the outer pipe, the EGR mixer comprising:

a pipe body having an inner passage and a plurality of through holes communicating the inner passage with the annular passage; and a plurality of diffusers equipped to the through holes, respectively, wherein the diffusers are arranged along a circumferential direction of the pipe body and projected radially inward from an inner periphery of the pipe body into the inner passage, and at least one of the diffusers is in a conical shape having a plurality of apertures, wherein the at least one diffuser has a sidewall extending in a circumferential direction of the at least one diffuser, the sidewall defines an inner space that is reduced toward a tip end and the diffuser further has a top wall at the tip end, and the top wall has at least one of the apertures.

* * * * *